US011056094B2

(12) United States Patent
Park et al.

(10) Patent No.: US 11,056,094 B2
(45) Date of Patent: Jul. 6, 2021

(54) METHOD AND APPARATUS FOR PROCESSING AUDIO SIGNAL

(71) Applicant: Samsung Electronics Co., Ltd., Suwon-si (KR)

(72) Inventors: Jinho Park, Suwon-si (KR); Guiwon Seo, Suwon-si (KR); Jonghwa Lee, Suwon-si (KR); Hyeongcheol Jeong, Suwon-si (KR); Sungwon Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/503,990

(22) Filed: Jul. 5, 2019

(65) Prior Publication Data

US 2020/0027437 A1 Jan. 23, 2020

(30) Foreign Application Priority Data

Jul. 17, 2018 (KR) ..... 10-2018-0083141

(51) Int. Cl.
*G10K 11/178* (2006.01)

(52) U.S. Cl.
CPC .... *G10K 11/178* (2013.01); *G10K 2210/1081* (2013.01); *G10K 2210/3221* (2013.01)

(58) Field of Classification Search
USPC ..... 381/71.1, 71.6, 71.8
See application file for complete search history.

(56) References Cited

U.S. PATENT DOCUMENTS 5,819,745 A 10/1998 Mobley et al.
6,820,717 B2 11/2004 Fleming et al.
8,000,486 B2 * 8/2011 Hildebrandt ..... H04R 1/1075 381/309
8,335,320 B2 12/2012 Abe et al.
8,989,427 B2 3/2015 Silvestri et al.
9,047,855 B2 6/2015 Bakalos
(Continued)

FOREIGN PATENT DOCUMENTS

GB 2 188 210 A 9/1987
KR 10-1025786 A 4/2011
(Continued)

OTHER PUBLICATIONS

International Search Report dated Oct. 18, 2019, issued in an International application No. PCT/KR2019/008382.
(Continued)

*Primary Examiner* — Disler Paul
(74) *Attorney, Agent, or Firm* — Jefferson IP Law, LLP

(57) ABSTRACT

A method and audio apparatus for processing an audio signal are provided. The audio apparatus includes at least one microphone to acquire ambient sound of the audio apparatus, a speaker to output the audio signal, an air pressure regulator including a fluid tube connecting an external space of a housing of the audio apparatus to an internal space of the housing, and configured to adjust a change in an air pressure of the internal space of the housing and an audio signal processor configured to generate an anti-noise signal for canceling noise in the ambient sound by using the acquired ambient sound and output the generated anti-noise signal and the audio signal through the speaker.

19 Claims, 16 Drawing Sheets

(56) References Cited

U.S. PATENT DOCUMENTS

| | | | | |
|---|---|---|---|---|
| 9,301,040 | B2 * | 3/2016 | Annunziato | H04R 1/2826 |
| 9,398,366 | B2 * | 7/2016 | Gleißner | H04R 1/1083 |
| 9,402,140 | B2 | 7/2016 | Kim | |
| 9,497,530 | B1 | 11/2016 | Campbell et al. | |
| 9,621,979 | B2 | 4/2017 | Bakalos | |
| 9,794,672 | B2 | 10/2017 | Campbell et al. | |
| 2007/0121974 | A1 | 5/2007 | Nemirovski | |
| 2008/0137873 | A1 | 6/2008 | Goldstein | |
| 2010/0266136 | A1 * | 10/2010 | Kelloniemi | G10K 11/178 381/71.6 |
| 2011/0079227 | A1 | 4/2011 | Turcot et al. | |
| 2013/0272530 | A1 * | 10/2013 | Gauger, Jr. | H04R 1/10 381/59 |
| 2014/0185819 | A1 * | 7/2014 | Gleissner | H04R 1/1083 381/71.6 |
| 2015/0264467 | A1 | 9/2015 | Annunziato et al. | |
| 2016/0150310 | A1 | 5/2016 | Bakalos | |
| 2016/0267898 | A1 | 9/2016 | Terlizzi | |
| 2017/0105876 | A1 | 4/2017 | O'Connell, Sr. et al. | |
| 2017/0202710 | A1 | 7/2017 | Van'T Hof et al. | |
| 2017/0208380 | A1 | 7/2017 | Slater et al. | |
| 2017/0223443 | A1 * | 8/2017 | Silvestri | H04R 1/2849 |
| 2017/0263236 | A1 | 9/2017 | Boesen et al. | |
| 2017/0270906 | A1 * | 9/2017 | Kwatra | G10K 11/178 |
| 2017/0332163 | A1 | 11/2017 | Yamkovoy | |
| 2017/0347177 | A1 | 11/2017 | Masaki et al. | |
| 2018/0000686 | A1 | 1/2018 | George et al. | |
| 2018/0286373 | A1 * | 10/2018 | O'Connell | G10K 11/17881 |
| 2019/0029593 | A1 * | 1/2019 | Orron | A61B 5/02416 |

FOREIGN PATENT DOCUMENTS

| | | | |
|---|---|---|---|
| KR | 10-1192293 | B1 | 10/2012 |
| KR | 10-2015-0038855 | A | 4/2015 |
| KR | 10-1535112 | | 7/2015 |
| WO | 2010-021417 | A | 2/2010 |
| WO | 2015/142630 | A1 | 9/2015 |

OTHER PUBLICATIONS

Extended European Search Report dated Mar. 11, 2021, issued in European Patent Application No. 19837932.3.

* cited by examiner

METHOD AND APPARATUS FOR PROCESSING AUDIO SIGNAL

CROSS-REFERENCE TO RELATED APPLICATION(S)

This application is based on and claims priority under 35 U.S.C. § 119 of a Korean patent application number 10-2018-0083141, filed on Jul. 17, 2018, in the Korean Intellectual Property Office, the disclosure of which is incorporated by reference herein in its entirety.

BACKGROUND

1. Field

The disclosure relates to a method and audio apparatus for processing an audio signal. More particularly, the disclosure relates to an audio apparatus for improving quality of an audio signal by canceling noise.

2. Description of Related Art

An audio apparatus such as headphones or earphones may use various noise canceling techniques. For example, an audio apparatus may obtain ambient sound around the audio apparatus by using a microphone connected to a noise cancellation circuit and cancel noise in the ambient sound around the audio apparatus to output to a user an audio signal having an improved quality.

An audio apparatus may determine an ambient noise environment and actively cancel noise by using an active noise cancellation (ANC) technique. An audio apparatus using the ANC technique may be designed to offset ambient noise by actively canceling noise by using the ambient noise environment when an audio signal provided by an electronic device is provided to a user.

When a user wearing an audio apparatus such as earphones or a headset is exposed to an environment having a difference in air pressure, the user may experience an expansion of the eardrums due to a change in the air pressure.

The Eustachian tube inside the human ear is intermittently opened so that pressure in the middle ear is in balance with the atmospheric pressure. In an environment where the atmospheric pressure is suddenly changed, such as in a high-speed elevator or an aircraft takeoff and landing, it is difficult to completely get rid of the pain and discomfort caused by the expansion of the Eustachian tube, by passively opening and closing the Eustachian tube. Thus, a user may be inconvenienced due to expansion of the eardrums caused by the sudden change in air pressure.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an audio signal processing method and an audio apparatus, in which the inconvenience for a user due to a sudden change in air pressure is resolved and noise may be actively cancelled.

Another aspect of the disclosure is to provide an audio signal processing method and an audio apparatus for adjusting air pressure in the external auditory meatus of a user's ear and an active noise cancellation (ANC) level by using an air pressure in the external auditory meatus.

Additional aspects will be set forth in part in the description which follows and, in part, will be apparent from the description, or may be learned by practice of the presented embodiments.

In accordance with an aspect of the disclosure, an audio apparatus is provided. The apparatus includes at least one microphone to acquire ambient sound of the audio apparatus, a speaker to output the audio signal, an air pressure regulator including a fluid tube connecting an external space of a housing of the audio apparatus to an internal space of the housing, and configured to adjust a change in an air pressure of the internal space of the housing and an audio signal processor configured to generate an anti-noise signal for canceling noise in the ambient sound by using the acquired ambient sound, and output the generated anti-noise signal and the audio signal through the speaker.

The audio apparatus may be provided on a user's ear, and further includes a shielder to cover at least a portion of the housing to shield a space of the external auditory meatus of the user's ear from the external space of the housing, and the internal space of the housing and the space of the external auditory meatus may be maintained at a uniform air pressure by using the shielder.

The audio apparatus may further include a pressure sensor to sense an air pressure of the space of the external auditory meatus, wherein the audio signal processor is further configured to adjust an intensity of the anti-noise signal based on air pressure values sensed using the pressure sensor.

The audio signal processor may further be configured to control the speaker to output a test signal for each frequency, and control a second microphone to acquire a feedback signal which is the test signal that has returned after being reflected by the external auditory meatus of the user.

The audio signal processor may further be configured to adjust frequency characteristics of the audio signal by analyzing the feedback signal acquired using the second microphone, and the feedback signal may be acquired differently according to a structure of the space of the external auditory meatus of a user's ear.

In accordance with another aspect of the disclosure, an audio signal processing method is provided. The method includes adjusting a change in an air pressure of an internal space of a housing of the audio apparatus by using a fluid tube connecting an external space of the housing of the audio apparatus and the internal space of the housing, acquiring ambient sound of the audio apparatus by using at least one microphone, generating an anti-noise signal for canceling noise in the ambient sound by using the acquired ambient sound, and outputting the generated anti-noise signal and the audio signal through a speaker.

The audio apparatus may be provided on a user's ear, and the audio signal processing method may further include sensing an air pressure of the space of the external auditory meatus of the user's ear by using a pressure sensor, and wherein generating of the anti-noise signal includes generating the anti-noise signal based on the sensed air pressure of the space of the external auditory meatus.

The audio signal processing method may further include adjusting frequency characteristics of the audio signal according to a structure of the space of the external auditory meatus of the user's ear, wherein the audio signal having the adjusted frequency characteristics is output through the speaker together with the generated anti-noise signal.

The adjusting of the frequency characteristics of the audio signal may further include outputting a test signal for each frequency through the speaker, and acquiring, by using the second microphone, a feedback signal which is the test signal that has returned after being reflected by the external auditory meatus of the user's ear, wherein the frequency characteristics of the audio signal are adjusted by analyzing the acquired feedback signal.

The adjusting of the frequency characteristics of the audio signal may further include transmitting a result of analyzing the acquired feedback signal to the electronic device.

The adjusting of the frequency characteristics of the audio signal may further include acquiring acoustic feature information of a user by analyzing a feedback signal and acquiring an equalization (EQ) setting value by using the acquired acoustic characteristic information of the user.

The adjusting of the frequency characteristics of the audio signal may include acquiring an EQ setting value for preventing noise-induced deafness to prevent damage to the user's eardrum by using the acquired acoustic feature information of the user.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
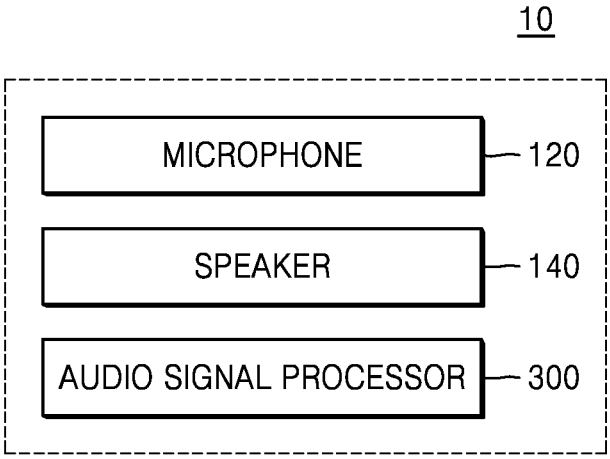
FIG. 1 is a block diagram of an audio apparatus according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms used in this specification are those general terms currently widely used in the art in consideration of functions in regard to the disclosure, but the terms may vary according to the intention of those of ordinary skill in the art, precedents, or new technology in the art. Also, specified terms may be selected by the applicant, and in this case, the detailed meaning thereof will be described in the detailed description of the disclosure. Thus, the terms used in the specification should be understood not as simple names but based on the meaning of the terms and the overall description of the disclosure.

Throughout the specification, it will also be understood that when a component "includes" an element, unless there is another opposite description thereto, it should be understood that the component does not exclude another element but may further include another element. In addition, terms such as " . . . unit", " . . . module", or the like refer to units that perform at least one function or operation, and the units may be implemented as hardware or software or as a combination of hardware and software.

Hereinafter, the embodiments of the disclosure will now be described more fully with reference to the accompanying drawings, in which embodiments of the disclosure are shown such that one of ordinary skill in the art may easily work the disclosure. This disclosure may, however, be embodied in many different forms and should not be construed as limited to the embodiments of the disclosure set forth herein. Also, elements not related to description are omitted in the drawings for clear description of the disclosure, and like reference numerals in the drawings denote like elements throughout the specification.

Throughout the disclosure, the expression "at least one of a, b or c" indicates only a, only b, only c, both a and b, both a and c, both b and c, all of a, b, and c, or variations thereof.

FIG. 1 is a block diagram of an audio apparatus 10 according to an embodiment of the disclosure.

Referring to FIG. 1, the audio apparatus 10 according to the embodiment of the disclosure may include a microphone 120, a speaker 140, and audio signal processor 300. The illustrated components, however, are not all essential components. The audio apparatus 10 may be implemented by more components or less components than those illustrated.

According to an embodiment of the disclosure, the audio apparatus 10 may output an audio signal provided by an electronic device. For example, the audio apparatus 10 may be a device receiving an audio signal provided by an electronic device and outputting the received audio signal, such as a headset or earphones that output an audio signal provided by an electronic device. In addition, the electronic device may include various forms of an electronic device capable of storing an audio signal to be output from an audio apparatus, in a memory or reproducing a stored audio signal, and transmitting the reproduced audio signal to the audio apparatus 10.

An electronic device according to an embodiment of the disclosure refers to a device capable of providing an audio signal to the audio apparatus 10. For example, an electronic device according to the disclosure may be a smartphone, a digital camera, a laptop computer, a tablet PC, an e-book terminal, a digital broadcast terminal, a personal digital assistant (PDA), a portable multimedia player (PMP), or an MP3 player, but is not limited thereto.

Also, the audio apparatus 10 according to an embodiment of the disclosure may be a headset or earphones, but is not limited thereto. An audio signal according to an embodiment of the disclosure may include a digital signal transmitted by reproduction of an audio file of various formats such as .mp3, .wav or .flac, and also any signal via which sound may be output by the audio apparatus 10.

The microphone 120 according to an embodiment of the disclosure may acquire ambient sound around the audio apparatus 10 or a feedback signal, which is a test signal output from a speaker to measure a structure of a user's ear and has returned after being reflected by the external auditory meatus of the user's ear. For example, the microphone 120 may include a first microphone acquiring ambient sound around the audio apparatus 10 and a second microphone receiving the ambient sound around the audio apparatus 10 and an audio signal output from a speaker.

The speaker 140 according to an embodiment of the disclosure outputs an audio signal provided by an electronic device. For example, the speaker 140 according to the disclosure may output an analog signal by converting an audio signal provided by an electronic device to a physical oscillation signal that is acoustically recognizable by a user. That is, an audio signal output from the speaker 140 according to the disclosure may include an analog signal that is acoustically recognizable by a user.

The audio signal processor 300 according to an embodiment of the disclosure may generate an anti-noise signal for canceling noise in the ambient sound by using the ambient sound obtained using the microphone 120 and output the anti-noise signal and an audio signal by using a speaker.

Figure 2:
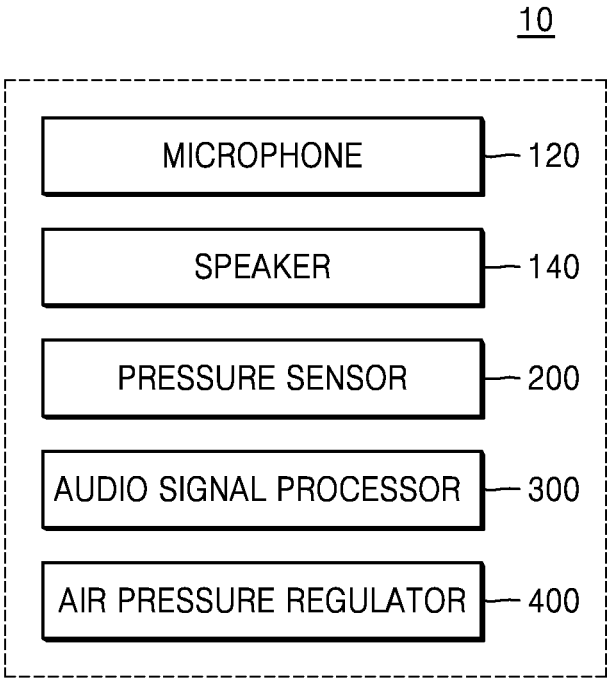
FIG. 2 is a block diagram of an audio apparatus according to an embodiment of the disclosure.

FIG. 2 is a block diagram of an audio apparatus 10 according to an embodiment of the disclosure.

Referring to FIG. 2, the audio apparatus 10 includes a microphone 120, a speaker 140, a pressure sensor 200, an audio signal processor 300, and an air pressure regulator 400. The illustrated components, however, are not all essential components. The audio apparatus 10 may be implemented using more or fewer components than those illustrated, and as in the embodiment of the disclosure of FIG. 1, the audio apparatus 10 may also be implemented by using other components except for the pressure sensor 200 and the air pressure regulator 400. This will be described with reference to FIG. 3.

For example, the audio apparatus 10 according to the disclosure may include a microphone 120, a speaker 140, a pressure sensor 200, an audio signal processor 300, and an air pressure regulator 400, and may further include a communicator 500 (e.g., a transceiver) and a user interface 600. The audio apparatus 10 according to the disclosure may be connected to an electronic device via the communicator 500 in a wired or wireless manner and may receive a user command for controlling the audio apparatus 10 via the user interface 600. In the embodiment of the disclosure of FIG. 2, the microphone 120 and the speaker 140 may be respectively the same as the microphone 120 and the speaker 140 of the embodiment of the disclosure of FIG. 1.

The active noise cancellation (ANC) technique used by the audio apparatus 10 according to the disclosure includes a technique of obtaining noise in ambient sound of the audio apparatus 10 and actively canceling noise by using an anti-noise signal having a reverse phase of the noise in the ambient sound. The audio signal processor 300 according to the disclosure may include at least one processor for performing ANC described above, generate an anti-noise signal by using the processor, and output the anti-noise signal through a speaker.

The audio apparatus 10 according to another embodiment of the disclosure may perform ANC at different levels based on an air pressure of the external auditory meatus of a user's ear sensed using the pressure sensor 200. For example, the condition of the eardrum of a user may be determined by measuring an air pressure of a space of the external auditory meatus of the user sensed using the pressure sensor 200, and adjust an ANC level by adjusting an intensity of an anti-noise signal based on the determined condition of the eardrum of the user.

The audio apparatus 10 according to the disclosure may determine an optimum ANC level by determining the condition of the eardrum of the user's ear based on the air pressure of the space in the external auditory meatus of the user's ear sensed using the pressure sensor 200. In detail, the audio apparatus 10 according to the disclosure may determine a noise cancellation coefficient for adjusting an intensity of an anti-noise signal based on the air pressure of the space in the external auditory meatus of the user's ear sensed using the pressure sensor 200 and determine an intensity of an optimal anti-noise signal by using the determined noise cancellation coefficient.

Accordingly, the audio apparatus 10 according to the disclosure may determine an optimal ANC level according to the condition of the eardrum of the user. In the disclosure, adjustment of an ANC level by using the audio apparatus 10 may correspond to adjustment of an intensity of an anti-noise signal corresponding to a reverse phase signal of a noise signal in ambient sound around the audio apparatus 10 or adjustment of a frequency or power of an anti-noise signal.

The audio apparatus 10 according to the disclosure may perform ANC according to an ANC level determined based on an air pressure of the space of the external auditory meatus of the user's ear sensed using the pressure sensor 200, and may also adjust the air pressure of the space of the external auditory meatus of the user's ear by using the air pressure regulator 400 at the same time. For example, the space of the external auditory meatus of the user's ear corresponds to at least a portion of the external auditory canal of the user's ear. For example, when an air pressure outside the audio apparatus 10 according to the disclosure changes abruptly, the audio apparatus 10 may slowly adjust the air pressure of the space of the external auditory meatus of the user's ear, thereby minimizing the inconvenience to the user.

That is, in order to prevent inconvenience to the eardrum of the user's ear expanded due to the air pressure outside the audio apparatus 10 that changes abruptly, the audio apparatus 10 according to the disclosure may perform ANC of different ANC levels based on the air pressure sensed in the space of the external auditory meatus of the user's ear and adjust the air pressure in the space of the external auditory meatus by using the air pressure regulator 400, thereby minimizing the inconvenience that the user wearing the audio apparatus 10 senses in the ear (pain due to the expanded eardrum).

Figure 3:
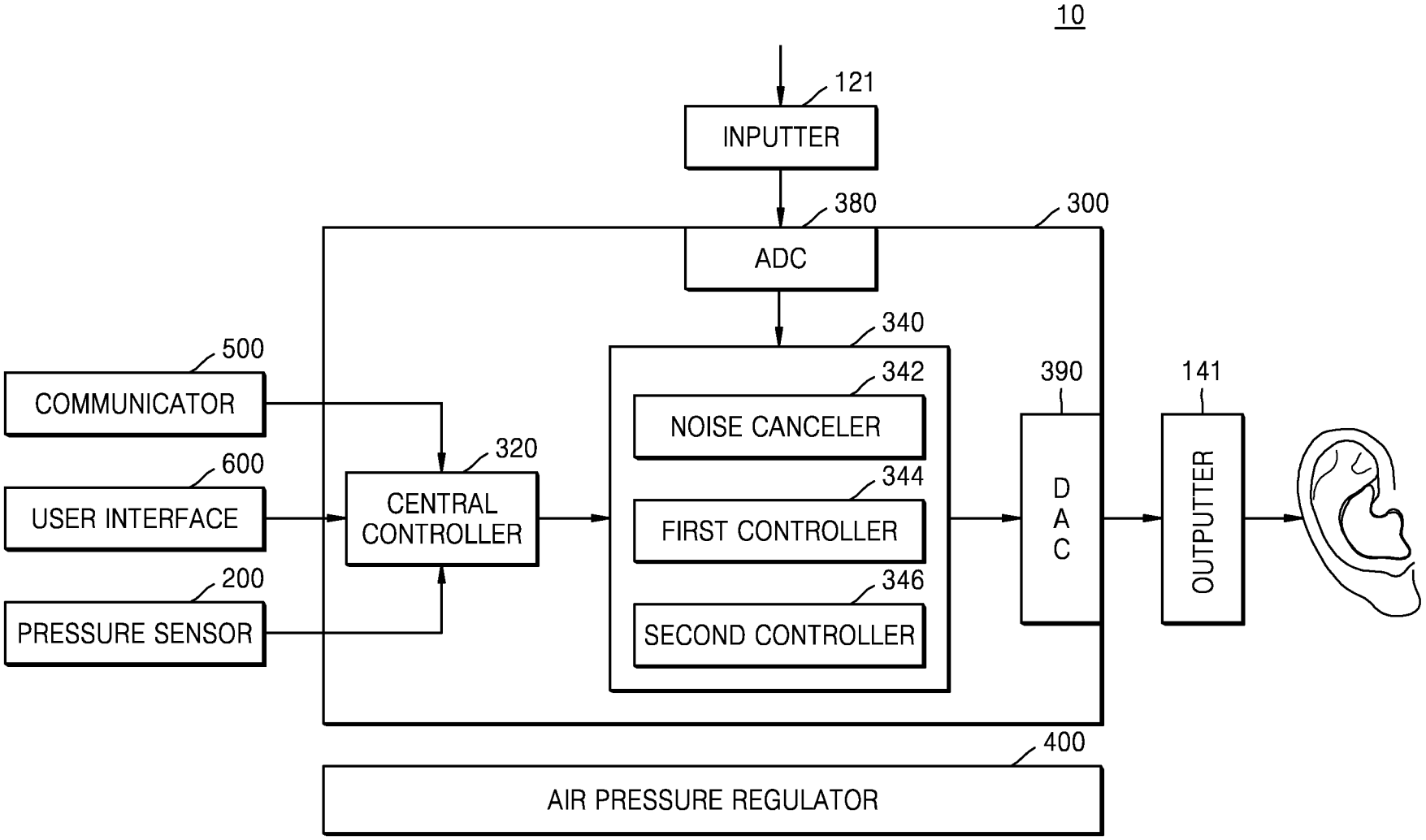
FIG. 3 is a block diagram of an audio apparatus according to an embodiment of the disclosure.

FIG. 3 is a block diagram of an audio apparatus 10 according to an embodiment of the disclosure.

Referring to FIG. 3, the audio apparatus 10 may include an inputter 121, an outputter 141, a pressure sensor 200, an audio signal processor 300, an air pressure regulator 400, a communicator 500, and a user interface 600. For example, the inputter 121 in the embodiment of the disclosure of FIG. 3 may be identical to the microphone 120 in the embodiment of the disclosure of FIG. 2, and the outputter 141 in the embodiment of the disclosure of FIG. 3 may be identical to the speaker 140 in the embodiment of the disclosure of FIG. 2.

The pressure sensor 200 senses an air pressure of the space of the external auditory meatus. For example, the pressure sensor 200 according to the disclosure may be located in an internal space of a housing of the audio apparatus 10 and sense an air pressure in the internal space of the housing. According to an embodiment of the disclosure, a location of the pressure sensor 200 according to the disclosure is not limited to the internal space of a housing 800, but the pressure sensor 200 may also be arranged outside the housing 800. When the audio apparatus 10 according to the disclosure is put on the user's ear, the internal space of the housing of the audio apparatus 10 may be spatially connected to the space of the external auditory meatus of the user's ear. As a result, sensing an air pressure in the internal space of the housing of the audio apparatus 10 by using the pressure sensor 200 may be identical to measuring an air pressure of the space of the external auditory meatus of the user's ear.

As will be described later, the audio apparatus 10 according to the disclosure may shield, from the external space of the housing of the audio apparatus 10, a space formed by connecting the internal space of the housing and the space of the external auditory meatus when the audio apparatus 10 is put on the user's ear, by using a shielder that at least partially covers an outer portion of the housing of the audio apparatus 10. Accordingly, an air pressure of the space where the internal space of the housing of the audio apparatus 10 and the space of the external auditory meatus of the user's ear are connected may be maintained uniform.

The audio apparatus 10 according to the disclosure may include at least one of a geomagnetic sensor, an acceleration sensor, a tilt sensor, an infrared sensor, a gyroscope sensor, a position sensor, a proximity sensor, an optical sensor, or a temperature sensor in addition to the pressure sensor 200, but is not limited thereto. The function of each sensor is intuitively deducible from its name by one of ordinary skill in the art, and thus detailed description thereof will be omitted.

The audio signal processor 300 may include a central controller 320, an ANC module 340, an analog-to-digital converter (ADC) 380, and a digital-to-analog converter (DAC) 390. The audio signal processor 300 may generate an anti-noise signal for canceling noise in ambient sound and output the anti-noise signal and an audio signal through a speaker by controlling the inputter 121, the outputter 141, the communicator 500, and the user interface 600.

The central controller 320 controls the inputter 121, the outputter 141, the pressure sensor 200, the ADC 380, the DAC 390, the communicator 500, and the user interface 600. For example, the central controller 320 may control the inputter 121 to acquire ambient sound around the audio apparatus 10, an audio signal output through a speaker, and a feedback signal, which is a test signal output from the speaker and has returned after being reflected by the external auditory meatus of the user's ear. Also, the central controller 320 may control the outputter 141 to output an audio signal, a test signal, and an anti-noise signal.

For example, the central controller 320 may control the ADC 380 to convert analog signals received by the inputter 121 into digital signals and transfer the digital signals to the ANC module 340. Also, the central controller 320 may control the DAC 390 to receive an anti-noise signal from the ANC module 340 and convert the anti-noise signal to an analog signal and output the analog signal (the anti-noise signal in analog signal format) through the outputter 141.

According to an embodiment of the disclosure, the central controller 320 may receive air pressure values of the space of the external auditory meatus of the user's ear sensed using the pressure sensor 200 and transfer the received air pressure values to the ANC module 340. Accordingly, the audio signal processor 300 may adjust an intensity of an anti-noise signal based on the air pressure values sensed using the pressure sensor 200. The central controller 320 may control the communicator 500 to receive an audio signal from an electronic device and control the user interface 600 to receive a command for controlling an operation of the audio apparatus 10.

According to an embodiment of the disclosure, the central controller 320 may further include a third controller. The third controller may control the speaker 140 to output a test signal for each frequency, and control a second microphone to acquire a feedback signal, which is a test signal output from the speaker 140 and has returned after being reflected by the external auditory meatus of the user's ear, and analyze the feedback signal acquired using the second microphone to adjust frequency characteristics of an audio signal to be output from the speaker 140.

Also, the third controller may adjust frequency characteristics of the audio signal by further using an amplitude of a test signal output from the speaker 140 or hardware characteristics of the speaker 140. For example, hardware characteristics of a speaker may refer to physical characteristics of an oscillation plate or a non-woven fabric constituting the speaker. The third controller may adjust frequency characteristics of an audio signal by further using physical characteristics of the speaker 140, thereby enhancing a quality of an audio signal to be output from the speaker 140.

Also, a function of the third controller may be performed using at least one processor in the audio signal processor 300.

The ANC module 340 includes a noise canceler 342, a first controller 344, and a second controller 346. For example, the ANC module 340 may control the inputter 121, the outputter 141, the ADC 380, and the DAC 390 to generate an anti-noise signal for canceling noise in ambient sound and output the anti-noise signal and an audio signal received from the central controller 320 through a speaker.

According to an embodiment of the disclosure, the ANC module 340 may receive, from the central controller 320, an air pressure value of a space in the external auditory meatus sensed using the pressure sensor 200, and determine a noise cancellation coefficient for adjusting an intensity of an anti-noise signal based on the air pressure value of the space in the external auditory meatus. In addition, the ANC module 340 may adjust an intensity of an anti-noise signal by using the determined noise cancellation coefficient, generate an anti-noise signal according to the determined anti-noise signal, and transfer the generated anti-noise signal to the DAC 390 or the outputter 141.

The noise canceler 342 generates an anti-noise signal for canceling noise in ambient sound. For example, an anti-noise signal generated using the noise canceler 342 may be a reverse phase signal of a noise signal in ambient sound around the audio apparatus 10. The ANC module 340 may output the anti-noise signal generated using the noise canceler 342 together with an audio signal through a speaker, thereby reducing noise in the ambient sound around the audio apparatus 10 transmitted to the user's ear.

The first controller 344 receives an air pressure value sensed using the pressure sensor 200, from the central controller 320, and determines a noise cancellation coefficient for adjusting an intensity of an anti-noise signal based on the received air pressure value. For example, the first controller 344 may estimate an average air pressure curve indicating a variation tendency in an air pressure of a space of the external auditory meatus by using an average of air pressure values sensed a plurality of times, and may further use the estimated average air pressure curve to determine a noise cancellation coefficient.

The second controller 346 determines an intensity of an anti-noise signal by using the noise cancellation coefficient determined by the first controller 344. The ANC module 340 may generate an anti-noise signal according to the intensity of the anti-noise signal determined by the second controller 346.

Functions of the central controller 320, the ANC module 340, the noise canceler 342, the first controller 344, and the second controller 346 included in the audio signal processor 300 may be performed using at least one processor. The audio apparatus 10 according to the disclosure may further include a storage unit storing a program for a processor performing the functions of the central controller 320, the ANC module 340, the noise canceler 342, the first controller 344, and the second controller 346.

For example, the storage unit may store programs for data processing of processors included in the audio signal processor 300, or store input data or output data (for example, an audio signal, an air pressure value sensed using a pressure sensor, or a microphone signal).

The storage unit may include, for example, an internal memory or an external memory. The internal memory may include, for example, a volatile memory (e.g., dynamic Random Access Memory (DRAM), static RAM (SRAM), or synchronous dynamic RAM (SDRAM)), a non-volatile memory (e.g., one-time programmable Read Only Memory) (OTPROM), programmable ROM (PROM), erasable and programmable ROM (EPROM), electrically erasable and programmable ROM (EEPROM), mask ROM, flash ROM, a flash memory (e.g., NAND flash or NOR flash), a hard drive, or a solid state drive (SSD).

An external memory may include a flash drive, for example, a compact flash (CF), a secure digital (SD) card, a micro-SD card, a mini secure digital (SD) card, an extreme digital (xD) card, a multi-media card (MMC), or a memory stick. An external memory may be connected to the audio apparatus 10 functionally and/or physically via various interfaces. Programs stored in a storage unit may be classified into a plurality of modules according to the functions thereof, for example, into a device control module and an ANC module, but are not limited thereto.

Functions of the central controller 320, the ANC module 340, the noise canceler 342, the first controller 344, the second controller 346, and the third controller included in the audio signal processor 300 may be performed using at least one processor. For example, functions of the central controller 320, the ANC module 340, the noise canceler 342, the first controller 344, and the second controller 346 may be performed using a single processor. Alternatively, a function of the ANC module 340 may be performed using one processor, and functions of the central controller 320 and the third controller may be performed using another processor.

Although not illustrated in the drawings of the disclosure, the audio apparatus 10 according to the disclosure may further include an additional memory storing instructions for executing a function of the audio signal processor 300 by a computer. Instructions for executing a function of the audio signal processor 300 by a computer may be stored as programmable code, and at least one processor included in the audio signal processor 300 may execute the instruction stored in the memory to perform an operation of the audio apparatus 10.

The air pressure regulator 400 may include a fluid tube connecting an external space of a housing of the audio apparatus 10 to an internal space of the housing, and adjust a change in an air pressure of the internal space of the housing. The communicator 500 may include at least one component that allows communication with an external apparatus, and may include, for example, at least one of a short-range communication module, a wired communication module, or a wireless communication module. For example, the wireless communication module according to the disclosure may transmit or receive a wireless signal to or from at least one of a base station, an external terminal, or a server. Here, a wireless signal may include various types of data such as a character/multimedia signal.

In addition, the short-range communication module may include a Bluetooth communication module, a Bluetooth Low Energy (BLE) communication module, a Near Field Communication module, a Wireless Local Access Network (WLAN) (WiFi) communication module, a Zigbee communication module, an Infrared Data Association (IrDA) communication module, a Wi-Fi Direct (WFD) communication module, an ultra wideband (UWB) communication module, an Ant+ communication module or the like, but is not limited thereto.

The user interface 600 according to the disclosure may receive, from a user, an operation control command for controlling an operation of an audio apparatus 10. For example, the user interface 600 may include a touch screen including a touchpad in a layered structure. The central controller 320 may determine a touch event of a user who touches a touch screen, as an operation control command for controlling an operation of the audio apparatus 10.

In addition, the user interface 600 may include a keypad, a dome switch, a touchpad (a contact type, capacitance type, a pressure resistive type, an infrared detection type, a surface acoustic wave conduction type, an integrated tension measuring method, a piezo-effect method, etc.), a jog wheel, a jog switch, and the like, via which a user input is received, but is not limited thereto.

Figure 4:
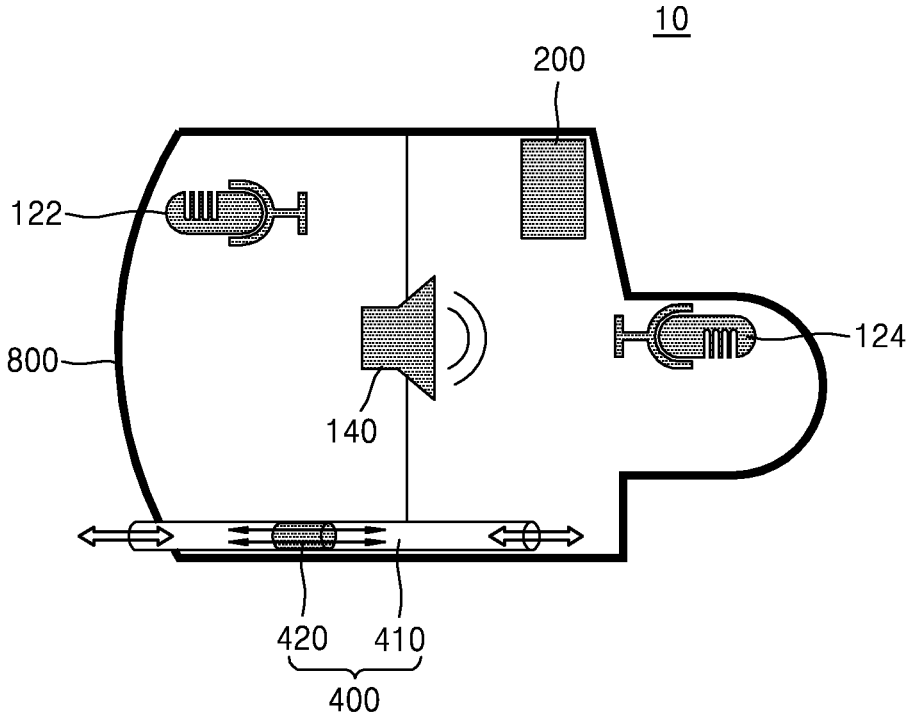
FIG. 4 illustrates an internal structure of an audio apparatus according to an embodiment of the disclosure.

FIG. 4 illustrates an example of an audio apparatus according to an embodiment of the disclosure.

Referring to FIG. 4, the audio apparatus 10 may include a first microphone 122, a second microphone 124, a speaker 140, a pressure sensor 200, and an air pressure regulator 400. The components illustrated in FIG. 4, however, are not all essential components, and positions of the components may be modified. According to an embodiment of the disclosure, the first microphone 122 may operate as a feed forward microphone, and the second microphone 124 may operate as a feedback microphone. For example, the audio apparatus 10 may operate in one of a feed forward method, a feedback method, and a hybrid method combining the feed forward method and the feedback method to perform ANC.

An example in which the audio apparatus 10 performs ANC by using a hybrid method by using both the first microphone 122 (feed forward method) and the second microphone 124 (feedback method) will be described. The first microphone 122 may be located in the housing 800 in a direction away from the user's ear and obtain ambient sound around the audio apparatus 10. The second microphone 124 may be located in the housing 800 at a relatively close distance to the user's ear and may receive ambient sound around the audio apparatus 10 and an audio signal output from the speaker 140. Also, the second microphone 124 may obtain a feedback signal, which is a test signal output from the speaker 140 and has returned after being reflected by the external auditory meatus of the user's ear. The feedback signal according to the disclosure may be obtained differently according to a structure of a space of the external auditory meatus of the user's ear.

The speaker 140 may output an audio signal provided by an electronic device and a test signal to determine a structure of a space of the external auditory meatus of the user's ear. The pressure sensor 200 may sense an air pressure in a space of the external auditory meatus according to the control by the central controller 320. The pressure sensor 200 may sense an air pressure of the space of the external auditory meatus a plurality of times according to the control by the central controller 320. When the audio apparatus 10 according to the disclosure is put on the user's ear, the internal space of the housing 800 is connected to the space of the external auditory meatus of the user's ear, and the connected space including the internal space of the housing 800 and the space of the external auditory meatus of the user's ear is separated from the external space of the housing 800, and thus, an air pressure in the internal space of the housing 800 may be maintained substantially equally to an air pressure of the space of the external auditory meatus of the user's ear. The pressure sensor 200 may be located inside the housing 800. The pressure sensor 200 may be located not only inside the housing 800, but may also be located outside the housing 800.

The air pressure regulator 400 may include a fluid tube 410 connecting the external space of the housing 800 to the internal space of the housing 800 of the audio apparatus 10 and adjust a change in an air pressure of the internal space of the housing 800. The air in the external space and the internal space of the housing 800 may flow through the fluid tube 410. The fluid tube 410 according to the disclosure may further include a porous member 420 that prevents a flow of the air flowing through the fluid tube 410, between the external space and the internal space of the housing 800, and the porous member 420 may be located in the fluid tube 410. According to an embodiment of the disclosure, the porous member 420 may be a porous ceramic filter.

The air pressure regulator 400 may maintain a permeability of the air flowing between the external space and the internal space of the housing 800 within a certain range by using the porous member 420. Permeability refers to a volume of the air passing through the fluid tube 410 per unit time. According to an embodiment of the disclosure, a permeability of the porous member 420 according to the disclosure may be set to about $5.55*10^{-5}$ ml/sec to about $3.8*10^{-4}$ ml/sec, but is not limited thereto. For example, a permeability of the porous member 420 may vary according to an environment where the audio apparatus 10 is used (paragliding, scuba diving, or the like).

The air pressure regulator 400 maintains a uniform air permeability of the air flowing between the external space and the internal space of the housing 800 so that an air pressure of the internal space of the housing 800 does not change abruptly while an air pressure of the external space of the housing 800 (atmospheric pressure) changes abruptly. That is, the air pressure regulator 400 may minimize the inconvenience to the user's ears (pain caused by the expansion of the eardrum) by preventing abrupt changes in the air pressure of the internal space of the housing 800.

Figure 5:
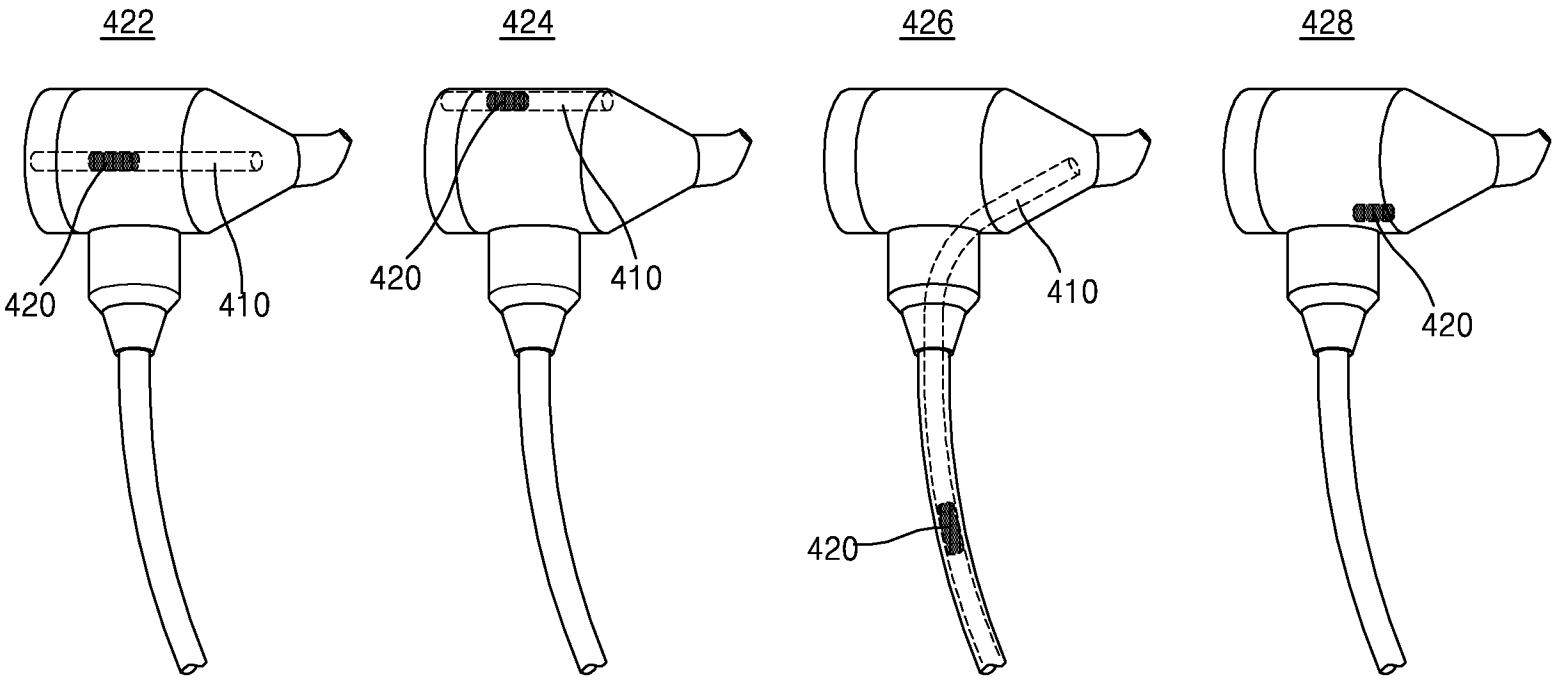
FIG. 5 illustrates a position of an air pressure regulator according to an embodiment of the disclosure.

FIG. 5 illustrates a position of an air pressure regulator 400 according to an embodiment of the disclosure.

Referring to FIG. 5, the air pressure regulator 400 may be located in a center portion of the housing 800 (422) and pass through at least a portion of the housing 800 to connect the internal space to the external space of the housing 800. In addition, the air pressure regulator 400 may be located in an upper portion of the housing 800 (424) and pass through at least a portion of the housing 800 to connect the internal space to the external space of the housing 800.

According to an embodiment of the disclosure, the air pressure regulator 400 may be located inside a connection line (earplug) connected to the housing 800 of the audio apparatus 10 (426) and connect the external space to the internal space of the housing 800 via the connection line. In addition, the air pressure regulator 400 may not include the fluid tube 410 but only the porous member 420 and be located in the internal space of the housing 800 (428). The fluid tube 410 according to the disclosure may include a same material as that of the housing 800. Also, the porous member 420 may include a same material as or a different one from that of the fluid tube 410. However, the materials of the fluid tube 410 and the porous member 420 are not only limited to plastic, but may also be a glass-based material or silicon.

A location of the fluid tube 410 is not limited to the locations illustrated in FIG. 5. The fluid tube 410 according to the disclosure may be fixed inside the housing 800 while the fluid tube 410 passes a portion of the housing 800, and may be located at various locations in the housing 800.

According to an embodiment of the disclosure, frequency characteristics of an audio signal output from the speaker 140 may vary according to a location of the porous member 420 in the fluid tube 410. For example, the closer the porous member 420 is in the fluid tube 410 to the user's ear, a low-pass band of an audio signal output from the speaker 140 may be emphasized. In contrast, the farther the porous member 420 is in the fluid tube 410 from the user's ear, a low-pass band of an audio signal output from the speaker 140 may be suppressed. According to an embodiment of the disclosure, the audio apparatus 10 according to the disclosure may adjust a location of the porous member 420 in the fluid tube 410 to thereby reduce a difference in the frequency characteristics of an audio signal due to difference in individual audio apparatuses 10 caused during the manufacture of the audio apparatus 10.

According to an embodiment of the disclosure, for example, according to a location of the air pressure regulator 400 in the internal space of the housing 800, a length of the fluid tube 410 constituting the air pressure regulator 400 may vary. In addition, frequency characteristics of an audio signal output from the speaker 140 may vary according to a length of the fluid tube 410. For example, the longer the length of the fluid tube 410, the porous member 420 may be fixed at more various locations in the fluid tube 410. Accordingly, the longer the length of the fluid tube 410, the frequency characteristics of an audio signal output from the speaker 140 may be adjusted more variously.

Figure 6:
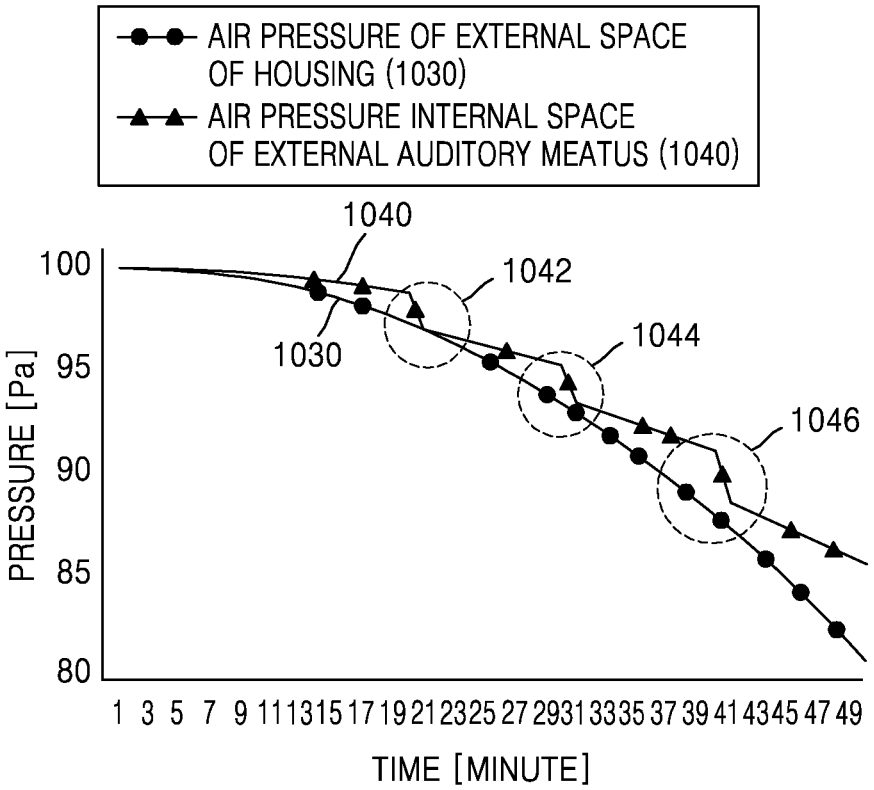
FIG. 6 shows a variation in an air pressure in the external auditory meatus, which is sensed using a pressure sensor according to an embodiment of the disclosure.

FIG. 6 shows a variation in an air pressure in the external auditory meatus sensed using the pressure sensor 200 according to an embodiment of the disclosure.

Referring to FIG. 6, the pressure sensor 200 may sense an air pressure in the space of the external auditory meatus of the user's ear according to the control by the central controller 320. The pressure sensor 200 may sense an air pressure in the space of the external auditory meatus of the user's ear a plurality of times according to the control by the central controller 320. The first controller 344 may receive air pressure values of the space of the external auditory meatus sensed a plurality of times, from the central controller 320, and estimate a curve of an air pressure of the space of the external auditory meatus. This will be described with reference to FIG. 7.

For example, when a user wearing the audio apparatus 10 according to the disclosure is in an airplane taking off, an air pressure of an external space 1002 of a housing of the audio apparatus 10 (the atmospheric pressure or an air pressure inside the airplane, 1030) may rapidly drop over time. However, the audio apparatus 10 may adjust an air pressure in the internal space of the housing 800 or that of a space 1004 in the external auditory meatus connected to the internal space of the housing 800, thereby slowing down the drop of the air pressure of the space 1004 of the external auditory meatus and thus eventually prevent an eardrum 1010 of the user's ear 1000 from abruptly expanding. Referring to FIG. 6, the air pressure 1040 of the space 1004 of the external auditory meatus decreases more slowly than the air pressure 1030 in the airplane (the external space 1002 of a housing of the audio apparatus).

The Eustachian tube located in the user's ear is intermittently opened to adjust the air pressure of the space 1004 in the user's external auditory meatus to be equal to the air pressure of the external space 1002 of the housing 800 of the audio apparatus 10. For example, when the Eustachian tube of the user's ear is not opened, the air pressure 1040 in the space 1004 in the external auditory meatus may be higher than an air pressure of the external space 1002 of the housing 800, and thus the eardrum 1010 of the user's ear may be expanded. On the other hand, when the Eustachian tube 1020 is opened, the air pressure 1040 of the space 1004 in the external auditory meatus is almost equal to the air pressure of the external space 1002 of the housing 800. Accordingly, when the Eustachian tube 1020 is opened, the eardrum of the user's ear 1000 may be in equilibrium or may be less expanded than the eardrum 1010 of the user's ear 1000 when the Eustachian tube 1020 is not opened.

The audio apparatus 10 according to the related art performs ANC at a uniform level without considering the condition of the eardrum of the user's ear, thus making a user have pain due to expansion of the eardrum. Accordingly, there is the need to determine a condition of the eardrum of the user's ear which varies depending on whether the Eustachian tube is opened or not, and to generate an anti-noise signal of different intensities based on the condition of the eardrum of the user's ear.

According to an embodiment of the disclosure, the first controller 344 according to the disclosure may determine a condition of an eardrum by using a variation of air pressure values sensed by using a pressure sensor a plurality of times, and determine a noise cancellation coefficient based on the determined condition of the eardrum. In detail, the first controller 344 may estimate an average air pressure curve by using air pressure values sensed using a pressure sensor a plurality of times. According to an embodiment of the disclosure, the first controller 344 may analyze a development in a variation in air pressure values over time by using average values of the air pressure values sensed per unit time. For example, the first controller 344 may estimate an average air pressure curve by using the determined average values. According to an embodiment of the disclosure, an average air pressure curve may be an air pressure trend line indicating a variation tendency in an air pressure of the space in the external auditory meatus.

According to an embodiment of the disclosure, the first controller 344 may estimate an average air pressure curve or an air pressure trend line by using a cost function that has a currently sensed air pressure value and a previously sensed air pressure value as inputs. When a difference between a current air pressure value of the space in the external auditory meatus sensed using a pressure sensor and an air pressure value corresponding to a current time in the average air pressure curve is equal to or less than a threshold, the first controller 344 may determine that the Eustachian tube is opened. When the Eustachian tube 1020 is opened, the eardrum 1010 of the user's ear 1000 may be in equilibrium or less expanded than the condition of the eardrum 1010 when the Eustachian tube 1020 is not opened, and thus, the first controller 344 determines a noise cancellation coefficient that increases an intensity of an anti-noise signal. Accordingly, the second controller 346 may determine a high intensity of an anti-noise signal by using a noise cancellation coefficient that increases the intensity of the anti-noise signal.

On the other hand, when a difference between a current air pressure value of the space in the external auditory meatus sensed using the pressure sensor and an air pressure value corresponding to a current time in the average air pressure curve is equal to or more than a threshold, the first controller 344 may determine that the Eustachian tube is not opened. When the Eustachian tube is not opened, the eardrum of the user's ear is expanded, and thus, the first controller 344 may determine a noise cancellation coefficient that decreases an intensity of an anti-noise signal. Accordingly, the second controller 346 may determine a low intensity of an anti-noise signal by using a noise cancellation coefficient that decreases the intensity of the anti-noise signal.

The noise canceler 342, the first controller 344, and the second controller 346 described above may correspond to at least one processor in the ANC module 340, and functions of the noise canceler 342, the first controller 344, and the second controller 346 may be performed using at least one processor in the ANC module 340. Also, operation of the noise canceler 342, the first controller 344, and the second controller 346 may be implemented using a computer program executed by at least one processor in the ANC module 340.

Figure 7:
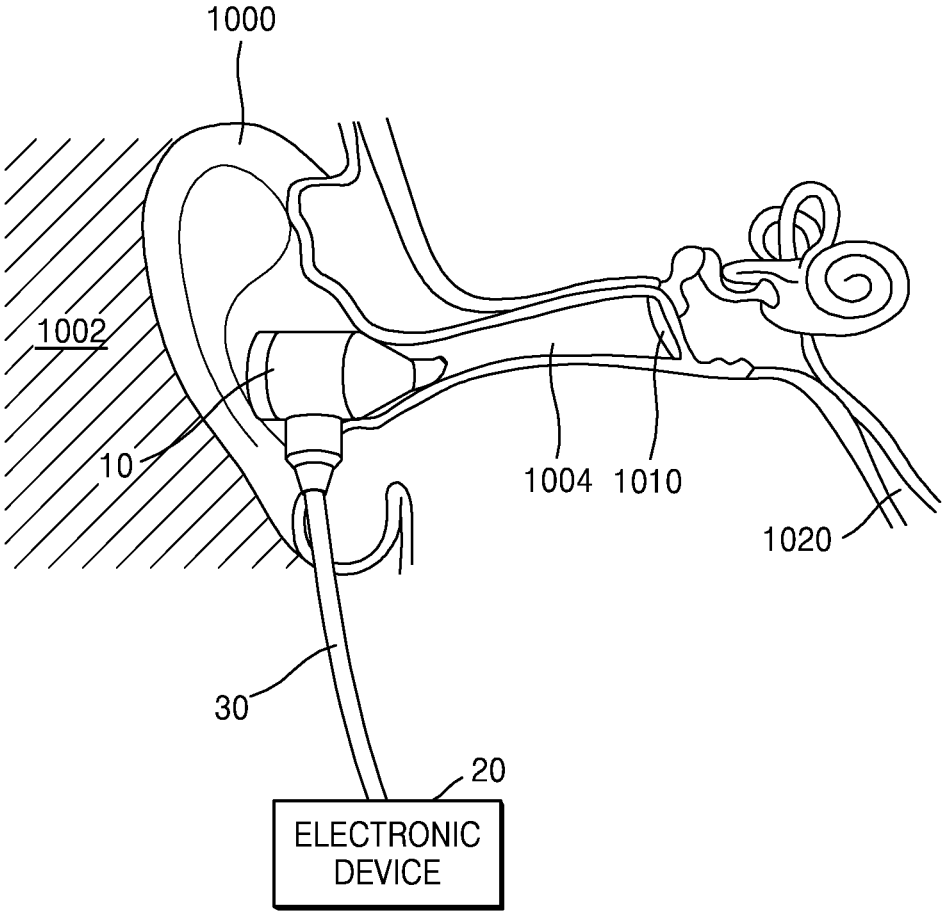
FIG. 7 illustrates an audio apparatus according to the disclosure, which is connected to an electronic device and put on the ear of a user according to an embodiment of the disclosure.

FIG. 7 illustrates an audio apparatus 10 according to the disclosure that is connected to an electronic device 20 and put on the ear of a user according to an embodiment of the disclosure.

Referring to FIG. 7, the audio apparatus 10 of the disclosure connected to the electronic device 20, via connector 30, may sense a pressure in the space 1004 in the external auditory meatus of the user's ear and determine a state of the eardrum 1010 by using the pressure in the space 1004 of the external auditory meatus, and may generate anti-noise signals of different intensities according to the condition of the eardrum 1010.

Figure 8:
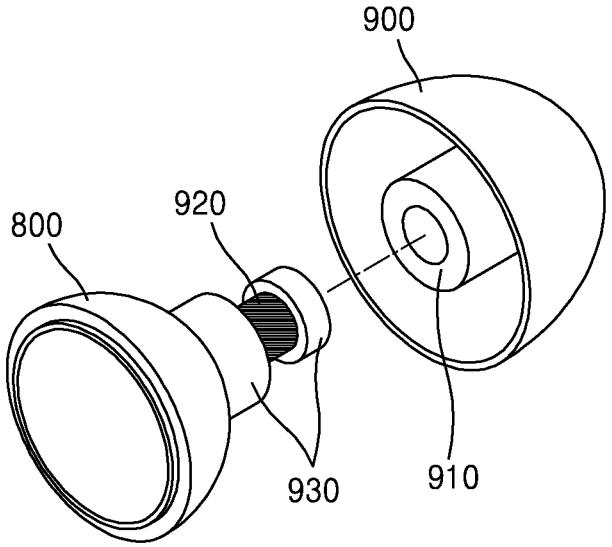
FIG. 8 illustrates a structure of a shielder according to an embodiment of the disclosure.

FIG. 8 illustrates a structure of a shielder 900 according to an embodiment of the disclosure.

Referring to FIG. 8, the shielder 900 may cover at least a portion of the housing 800 of the audio apparatus 10, thereby shielding the space 1004 of the external auditory meatus of the user's ear 1000 from the external space 1002 of the housing 800. The shielder 900 may maintain the internal space of the housing 800 and the space of the external auditory meatus connected to the internal space, at a uniform air pressure. According to an embodiment of the disclosure, the shielder 900 may be an ear tip or a form factor formed of an elastic material such as rubber or a silicon material. The shielder 900 according to the disclosure may have a shape suitable for an earphone, a neckband, or a headset.

Also, the shielder 900 may cover at least a portion of the housing 800 of the audio apparatus 10, and may also be coupled to a portion of the housing 800 at the same time. The housing 800 of the audio apparatus 10 may further include a first coupling portion 930 to be mechanically coupled to the shielder 900, and the shielder 900 may further include a second coupling portion 910 to be coupled to a portion of the housing 800 of the audio apparatus 10. According to the disclosure, the first coupling portion 930 of the housing 800 and the second coupling portion 910 of the shielder 900 of the audio apparatus 10 may be mechanically connected by using an elastic member 920. The elastic member 920 may include a silicon ring or a rubber ring. The elastic member 920 may be used to connect the first coupling portion 930 and the second coupling portion 910. The elastic member 920 may block leakage of the air through the first coupling portion 930 and the second coupling portion 910 when the housing 800 of the audio apparatus 10 and the shielder 900 are coupled to each other.

Figure 9:
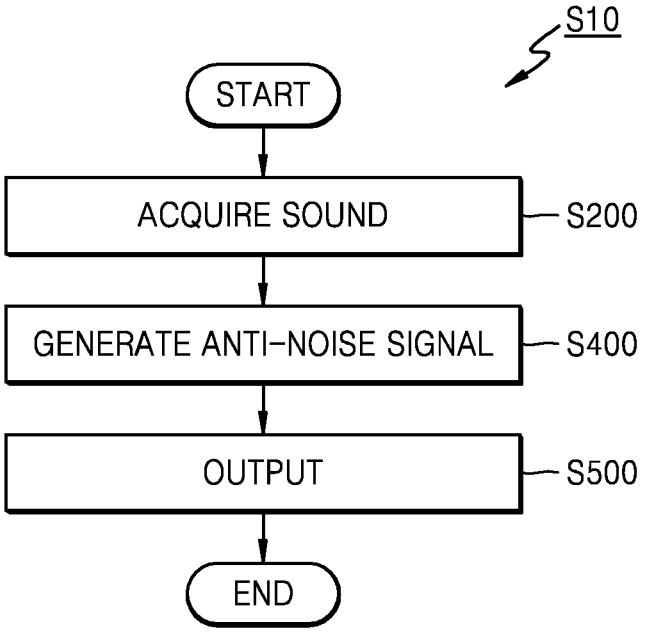
FIG. 9 is a flowchart of an audio signal processing method according to an embodiment of the disclosure.

FIG. 9 is a flowchart of an audio signal processing method according to an embodiment of the disclosure.

Referring to FIG. 9, in operation S200, at least one microphone 120 acquires ambient sound of the audio apparatus 10. According to an embodiment of the disclosure, the at least one microphone 120 may correspond to the inputter 121 and may include a first microphone 122 acquiring ambient sound of the audio apparatus 10 and a second microphone 124 receiving ambient sound around the audio apparatus 10, an audio signal and a feedback signal output from the speaker 140.

In operation S400, the audio signal processor 300 generates an anti-noise signal to cancel noise in the ambient sound by using the ambient sound acquired using the microphone 120. For example, the audio signal processor 300 may include an ANC module for performing ANC, and the ANC module may include at least one processor to perform active noise cancellation. Accordingly, at least one processor included in the ANC module 340 may generate an anti-noise signal by using the ambient sound acquired using the microphone 120.

In operation S500, the speaker 140 outputs the generated anti-noise signal and audio signal. For example, according to the control by the central controller 320 or the ANC module 340, the speaker 140 may output an anti-noise signal, an audio signal, and a test signal.

Figure 10:
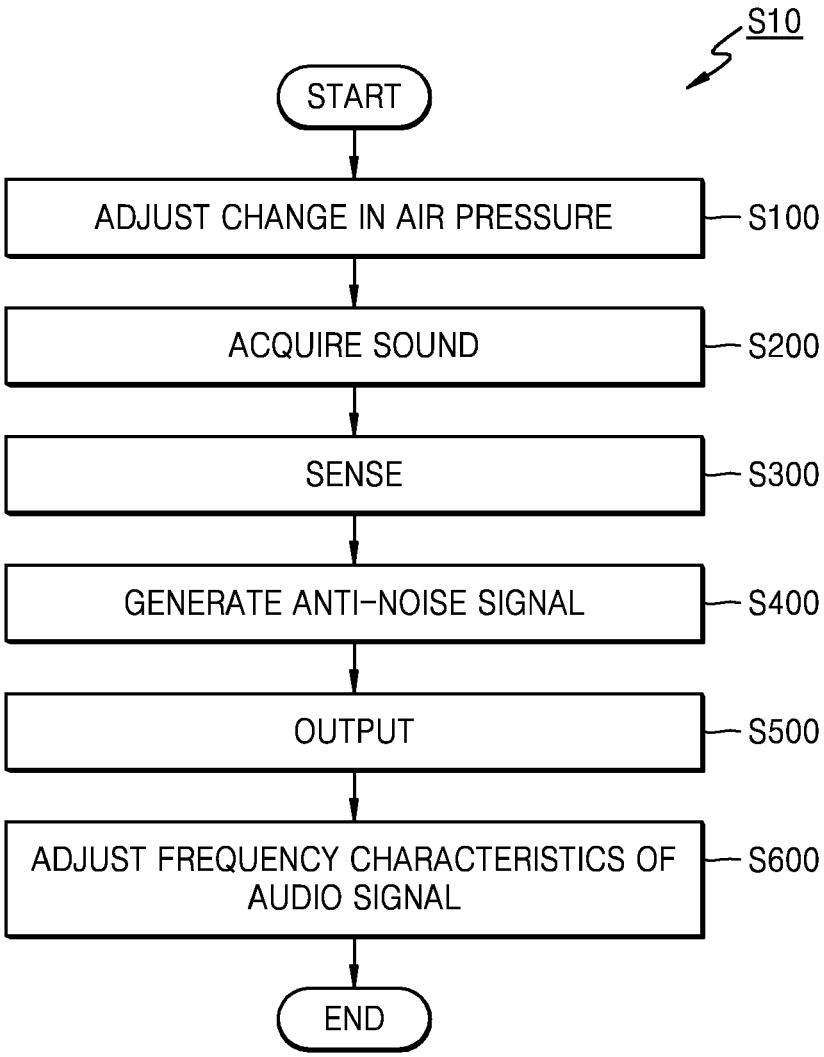
FIG. 10 is a flowchart of an audio signal processing method according to an embodiment of the disclosure.

FIG. 10 is a flowchart of an audio signal processing method according to an embodiment of the disclosure.

Referring to FIG. 10, in operation S100, the air pressure regulator 400 adjusts a variation in an air pressure in the internal space of a housing 800 or a space in the external auditory meatus connected to the internal space of the housing 800 by using a fluid tube connecting the external space 1002 of the housing 800 to the internal space of the housing 800. In operation S200, at least one microphone 120 acquires ambient sound of the audio apparatus 10.

In operation S300, the pressure sensor 200 senses an air pressure of the space of the external auditory meatus of the user's ear when the audio apparatus 10 is put on the user's ear. The audio apparatus 10 may generate an anti-noise signal based on an air pressure of the space of the external auditory meatus sensed using the pressure sensor 200.

In operation S400, the audio signal processor 300 may generate an anti-noise signal which is a reverse phase signal of ambient sound acquired using the microphone 120. In operation S500, the speaker 140 may output the generated anti-noise signal and audio signal together. For example, in addition to an anti-noise signal and an audio signal, the speaker 140 may output a test signal for each frequency to measure a structure of the external auditory meatus of the user's ear.

In operation S600, the central controller 320 may adjust frequency characteristics of the audio signal based on the structure of the external auditory meatus of the user's ear. For example, to measure the structure of the space of the external auditory meatus of the user's ear, the central controller 320 may control the speaker 140 to output a test signal for each frequency and control the second microphone 124 to receive a feedback signal, which is a test signal that has returned after being reflected by the space of the external auditory meatus of the user's ear.

For example, according to the control by the central controller 320, a test signal output from the speaker 140 may be a signal for real ear measurement, and may be output for each frequency. The central controller 320 may output a test signal through the speaker 140 in an order from a low frequency to a high frequency to measure a structure of the external auditory meatus of the user's ear. According to an embodiment of the disclosure, the central controller 320 may adjust frequency characteristics of an audio signal to be output through the speaker 140 by analyzing a feedback signal received via the second microphone 124.

Figure 11:
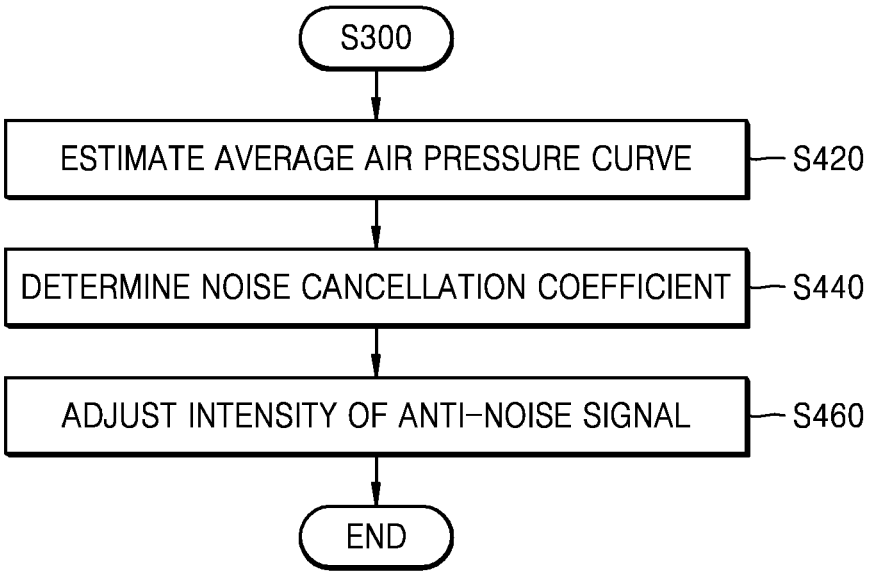
FIG. 11 is a detailed flowchart of an operation of generating an anti-noise signal in the embodiment of the disclosure of FIG. 10.

FIG. 11 is a detailed flowchart of an operation of generating an anti-noise signal in the embodiment of the disclosure of FIG. 10.

Referring to FIG. 11, in operation S420, the first controller 344 may estimate an average air pressure curve based on an air pressure of the space of the external auditory meatus sensed using the pressure sensor 200. According to an embodiment of the disclosure, the first controller 344 may analyze a development in a variation in air pressure values over time or estimate an average air pressure curve by using average values of the air pressure values sensed per unit time.

In operation S440, the first controller 344 may determine a condition of the eardrum of the user's ear according to whether the Eustachian tube is opened or not by using the estimated average air pressure curve, and determine a noise cancellation coefficient for differently adjusting an intensity of an anti-noise signal based on the condition of the eardrum of the user's ear. That is, the first controller 344 may determine a noise cancellation coefficient by using a variation in air pressure values sensed using the pressure sensor 200 a plurality of times.

In operation S460, the second controller 346 adjusts an intensity of an anti-noise signal by using the noise cancellation coefficient. In an operation of generating an anti-noise signal, an anti-noise signal may be generated using an intensity of an anti-noise signal adjusted by using the second controller 346.

Figure 12:
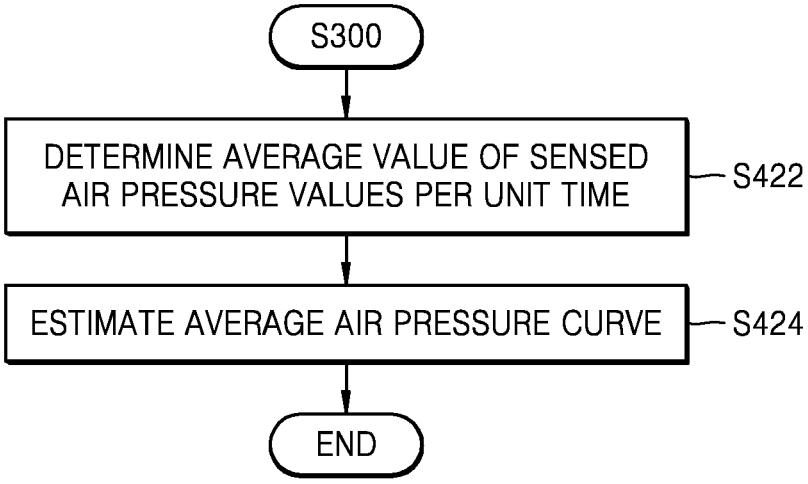
FIG. 12 is a detailed flowchart of an operation of estimating an air pressure curve in the embodiment of the disclosure of FIG. 11.

FIG. 12 is a detailed flowchart of an operation of estimating an air pressure curve in the embodiment of the disclosure of FIG. 11.

Referring to FIG. 12, in operation S422, the first controller 344 may determine average values of air pressure values sensed per unit time by using air pressure values sensed using the pressure sensor 200 a plurality of times. In operation S424, the first controller 344 may analyze a development of a variation in air pressure values over time by using average values of the air pressure values sensed per unit time. According to an embodiment of the disclosure, the first controller 344 may estimate an average air pressure curve by using average values of the air pressure values sensed per unit time.

Figure 13:
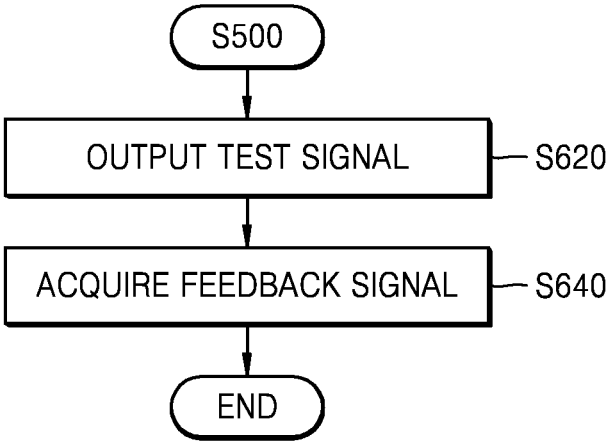
FIG. 13 is a detailed flowchart of an operation of adjusting frequency characteristics of an audio signal in the embodiment of the disclosure of FIG. 10.

FIG. 13 is a detailed flowchart of an operation of adjusting frequency characteristics of an audio signal in the embodiment of the disclosure of FIG. 10.

Referring to FIG. 13, in operation S620, the speaker 140 may output a test signal for measuring a structure of the space of the external auditory meatus of the user's ear according to the control by the central controller 320. In operation S640, the second microphone 124 may acquire, according to the control by the central controller 320, a feedback signal, which is a test signal output from the speaker 140 and has returned after being reflected by the external auditory meatus of the user's ear. The feedback signal acquired from the second microphone 124 may be obtained differently according to the structure of the space of the external auditory meatus of the user's ear. The central controller 320 may adjust frequency characteristics of an audio signal to be output from the speaker 140 by analyzing the feedback signal acquired using the second microphone 124.

In detail, the central controller 320 may acquire acoustic characteristic information of a user according to a structure of the space of the external auditory meatus of the user's ear by analyzing a feedback signal. The acoustic feature information of the user acquired by the central controller 320 may be, for example, an amplitude of a feedback signal, a frequency interval of a feedback signal, and a frequency pattern of a feedback signal acquired differently according to a structure of the space of the external auditory meatus of the user's ear. The central controller 320 may acquire an equalization (EQ) setting value that is suitable for a user by using the acquired acoustic feature information, and may adjust frequency characteristics of an audio signal to be output through the speaker 140 by using the EQ setting value.

Also, the central controller 320 may adjust frequency characteristics of an audio signal by further considering an amplitude of a test signal output from the speaker 140 or characteristic information of the speaker 140. Characteristic information of a speaker refers to hardware characteristics of a speaker, and may include, for example, physical characteristics of an oscillation plate or a non-woven fabric constituting a speaker.

According to an embodiment of the disclosure, although not illustrated in the drawings, the audio apparatus 10 may analyze an amplification gain by using acoustic feature information of a user acquired by analyzing a feedback signal received using the second microphone 124, and may acquire an EQ setting value for preventing noise-induced deafness to thereby prevent damage to the user's eardrum by using the analyzed amplification gain. Accordingly, the audio apparatus 10 may prevent damage to the user's hearing by adjusting frequency characteristics of an audio signal to be output through the speaker 140 by using the EQ setting value for preventing noise-induced deafness.

Also, although not illustrated in FIG. 13, after operation S640, the audio apparatus 10 may analyze an acquired feedback signal, and transmit an analysis result of the feedback signal to the electronic device 20. Alternatively, the audio apparatus 10 may transmit an EQ setting value acquired by analyzing the feedback signal, to the electronic device 20. The electronic device 20 may provide an EQ setting received from the audio apparatus 10 to a user, and the user may adjust frequency characteristics of an audio signal by using the EQ setting received from the electronic device 20.

Figure 14:
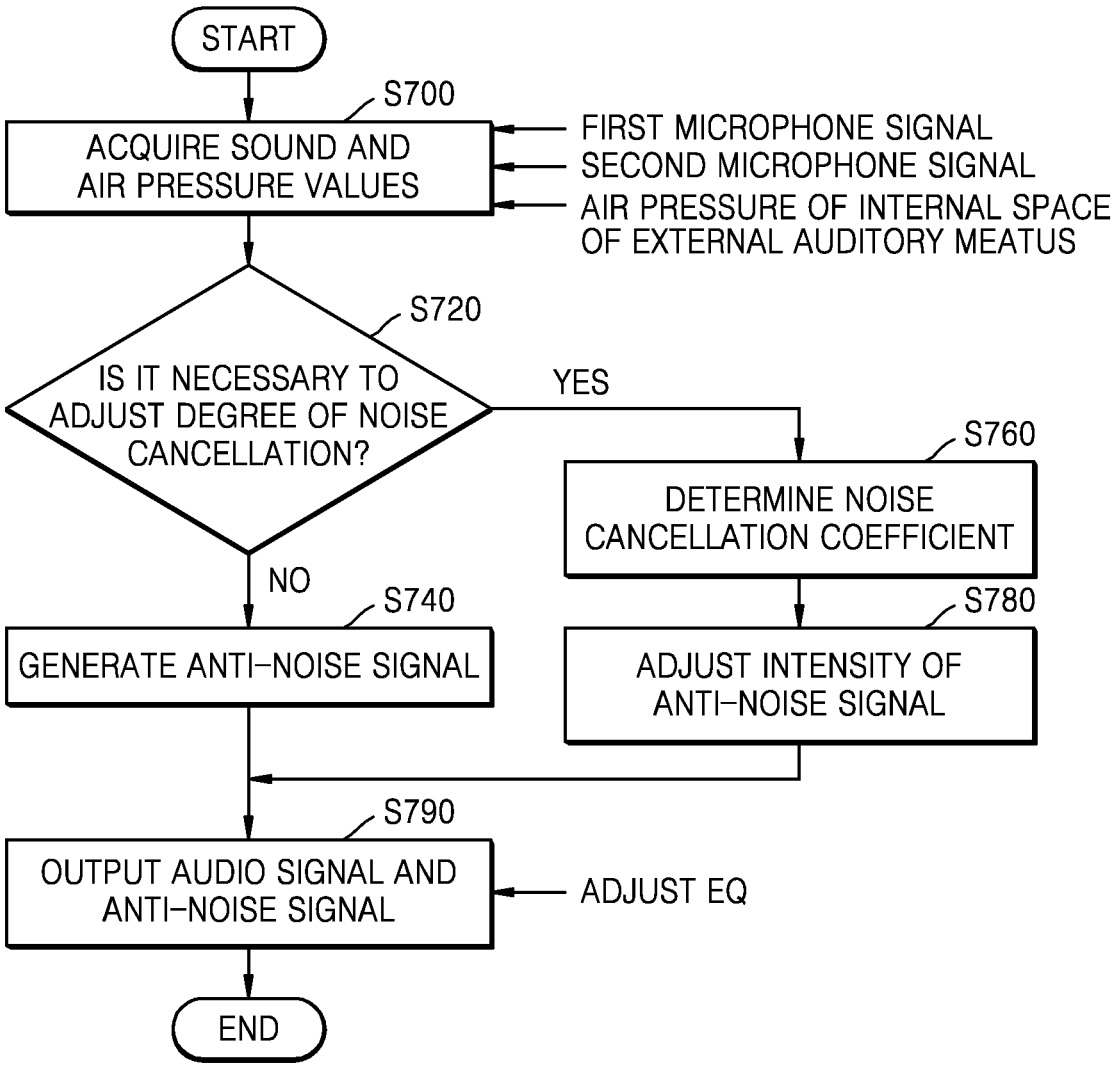
FIG. 14 is a flowchart of an audio signal processing method according to an embodiment of the disclosure.

FIG. 14 is a flowchart of an audio signal processing method according to an embodiment of the disclosure.

Referring to FIG. 14, in operation S700, the audio apparatus 10 acquires ambient sound of the audio apparatus 10 via at least one microphone 120. Also, the audio apparatus 10 may acquire air pressure values in the space of the external auditory meatus of the user's ear sensed using the pressure sensor 200.

In operation S720, the audio apparatus 10 may estimate a condition of the eardrum of the user's ear based on the air pressure value in the space of the external auditory meatus of the user's ear sensed using the pressure sensor 200, and determine whether a degree of noise cancellation is required to be adjusted, based on the estimated condition of the eardrum of the user's ear.

For example, when a variation in an air pressure value in the space of the sensed external auditory meatus is equal to or higher than a certain threshold value, 1042, 1044 and 1046 the audio apparatus 10 may estimate that the Eustachian tube is opened and the eardrum of the user's ear is in equilibrium and determine that an intensity of the anti-noise signal needs to be increased. Also, when a variation in an air pressure value in the space of the sensed external auditory meatus is equal to or lower than a certain threshold value, the audio apparatus 10 may estimate the Eustachian tube to be not opened and the eardrum of the user's ear to be expanded and determine that the intensity of the anti-noise signal needs to be reduced.

In operation S740, when the audio apparatus 10 has determined that adjustment of a degree of noise cancellation is not necessary, the audio apparatus 10 may not change the intensity of the anti-noise signal, and generate an anti-noise signal based on the unchanged intensity of the anti-noise signal.

In operation S760, when it is determined that a degree of noise cancellation needs to be adjusted, the audio apparatus 10 may determine a noise cancellation coefficient. For example, when a variation in an air pressure value in the space of the sensed external auditory meatus is equal to or lower than a certain threshold value or equal to or higher than the certain threshold value, the audio apparatus 10 determines a noise cancellation coefficient for adjusting an intensity of an anti-noise signal.

In operation S780, the audio apparatus 10 may determine an intensity of an anti-noise signal to be generated, by using the determined noise cancellation coefficient. The audio apparatus 10 may generate an anti-noise signal based on the determined intensity of the anti-noise signal.

In operation S790, the audio apparatus 10 may output an audio signal and an anti-noise signal. While an audio signal and an anti-noise signal are being output, the audio apparatus 10 may further output a test signal for measuring a structure of the space of the external auditory meatus of the user's ear through a speaker. Accordingly, while an audio signal and an anti-noise signal are being output, the audio apparatus 10 may analyze a feedback signal, which is a test signal output from the speaker and has returned after being reflected, thereby adjusting frequency characteristics of an audio signal to be output.

Figure 15:
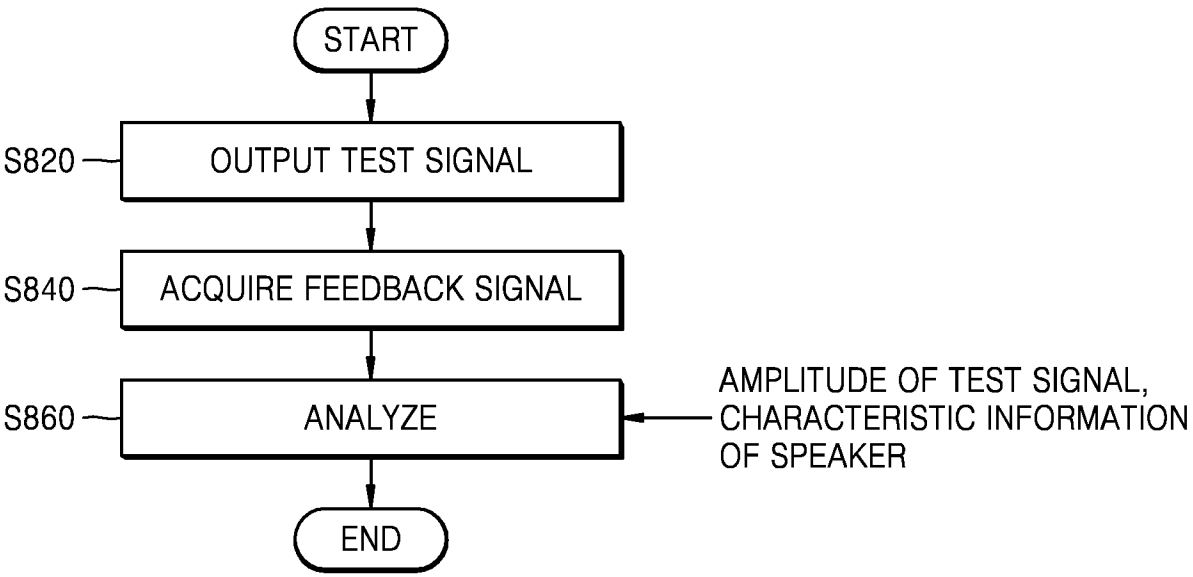
FIG. 15 is a flowchart of a method of adjusting frequency characteristics of an audio signal according to an embodiment of the disclosure.

FIG. 15 is a flowchart of a method of adjusting frequency characteristics of an audio signal according to an embodiment of the disclosure.

Referring to FIG. 15, the audio apparatus 10 may further output a test signal for measuring a structure of the space of the external auditory meatus of the user's ear through a speaker while an audio signal and an anti-noise signal are being output, and may analyze a feedback signal, which is a test signal output from the speaker and has returned after being reflected by the external auditory meatus, to thereby adjust frequency characteristics of an audio signal to be output.

However, before outputting an audio signal and an anti-noise signal, the audio apparatus 10 may analyze a feedback signal, which is a test signal output from the speaker 140 and has returned after being reflected by the external auditory meatus of the user, to adjust frequency characteristics of an audio signal to be output, in advance.

In operation S820, the audio apparatus 10 outputs a test signal for measuring a structure of the space of the external auditory meatus of the user's ear through a speaker before outputting an audio signal and an anti-noise signal. The audio apparatus 10 may output a test signal in an order from a low frequency to a high frequency. A test signal output from the speaker 140 may be a wireless signal of a single frequency.

In operation S840, the audio apparatus 10 acquires a feedback signal, which is a test signal output from the speaker 140 and has returned after being reflected by the external auditory meatus of the user's ear. For example, to perform hybrid-type ANC, the audio apparatus 10 may include a first microphone and a second microphone, and may acquire a feedback signal by using the second microphone. In operation S860, the audio apparatus 10 analyzes a feedback signal acquired using the second microphone. According to an embodiment of the disclosure, the audio apparatus 10 may analyze the acquired feedback signal by further using an amplitude of a test signal output through the speaker 140 and characteristics information of the speaker 140.

In the disclosure, the adjustment of the frequency characteristic by the audio device 10 may correspond to the adjustment of the equalization(EQ) value for each frequency component of the audio signal, using the acoustic characteristic information obtained from the feedback signal. According to an embodiment of the disclosure, the adjustment of the equalization value for each frequency component of the audio signal may correspond to adjustment of the balance (or balancing) between the each frequency component within the audio signal.

Figure 16:
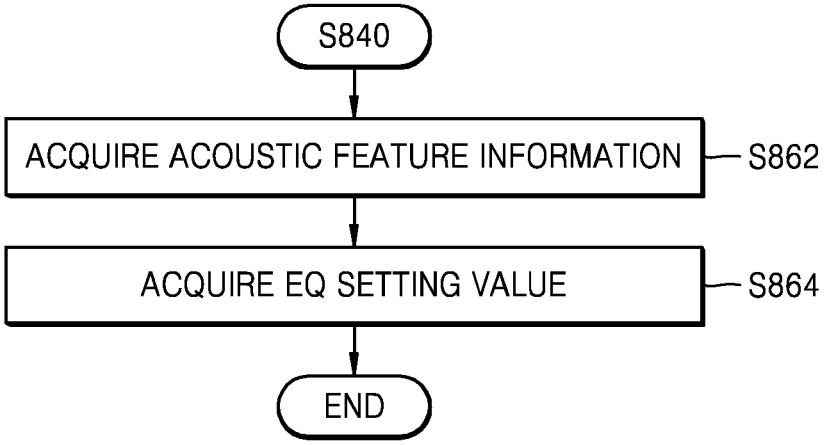
FIG. 16 is an expanded flowchart of an analyzing operation of the embodiment of the disclosure of FIG. 15.

FIG. 16 is an expanded flowchart of an analyzing operation of the embodiment of the disclosure of FIG. 15.

Referring to FIG. 16, in S852, the audio apparatus 10 may acquire acoustic feature information of a user according to a structure of the space of the external auditory meatus of the user's ear by analyzing a feedback signal. For example, the acoustic feature information includes an amplitude of a feedback signal, a frequency interval of a feedback signal, or a frequency pattern of a feedback signal, which are differently acquired according to the structure of the space of the external auditory meatus of the user's ear.

In operation S864, the audio apparatus 10 may acquire an EQ setting value suitable for a user by using the acquired acoustic feature information. For example, an EQ setting value may include a digital parameter for emphasizing low pass, middle pass, and high pass frequency characteristics of an output audio signal. The audio apparatus 10 may adjust frequency characteristics of an audio signal to be output through the speaker 140 by using an EQ setting value.

According to an embodiment of the disclosure, based on the frequency pattern of the feedback signal, the audio apparatus 10 may measure a feedback signal representing a low amplitude of a low-pass signal and a high amplitude of a high-pass signal. For example, the low-pass signal may comprise a low frequency component of the audio signal, and the high-pass signal may comprise a high frequency component of the audio signal.

According to an embodiment of the disclosure, the feedback signal having a low amplitude of a low-pass signal and a high amplitude of a high-pass signal, may represent that the structure of the space of the external auditory meatus of the user's ear relatively absorbs more a low frequency component of the audio signal.

According to one embodiment, when the feedback signal having a low amplitude of a low-pass signal and a high amplitude of a high-pass signal is acquired, the audio appratus 10 may adjust the frequency characteristics of the audio signal by adjusting the equalization value of the audio signal using an equalizing filter that increases the gain of the low-pass signal and reduces the gain of the high-pass signal of the audio signal. Thus, the user of the audio appratus 10 may listen to an audio signal having a better quality.

The method according to an embodiment of the disclosure may be implemented in the form of program commands that may be executed through various computer means and recorded on a computer recording medium. The computer-readable recording medium may include program commands, a data file, a data structure etc. alone or in combination. The program commands written to the computer recording medium may be specifically designed and configured for the embodiments of the disclosure or may be those well-known and available to one of ordinary skill in the art. Examples of the computer readable recording medium include magnetic media (e.g., hard disks, floppy disks, magnetic tapes, etc.), optical media (e.g., compact disc (CD)-ROMs, or DVDs), magneto-optical media (e.g., floptical disks), and hardware devices specifically configured to store and execute program commands (e.g., ROM, RAM, flash memories, etc.). Examples of the program commands include not only machine codes generated by using a compiler but also high-level language code that can be executed on a computer by using an interpreter or the like.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An audio apparatus for outputting an audio signal provided by an electronic device, the audio apparatus comprising:

at least one microphone configured to acquire an ambient sound of the audio apparatus;

a speaker configured to output the audio signal;

an air pressure regulator comprising a fluid tube connecting an external space of a housing of the audio apparatus to an internal space of the housing, the air pressure regulator being configured to adjust a change in an air pressure of the internal space of the housing, the fluid tube extending from the external space of the housing into the internal space of the housing, a portion of the fluid tube being fixed inside the housing; and an audio signal processor configured to:

generate an anti-noise signal by using the ambient sound acquired by the at least one microphone, the anti-noise signal being a signal that cancels noise in the ambient sound, and output the anti-noise signal and the audio signal through the speaker, wherein the air pressure regulator further comprises a porous member disposed in the fluid tube, the porous member being configured to suppress a flow of air flowing through the fluid tube between the external space of the housing and the internal space of the housing, and wherein a location of the porous member disposed in the fluid tube is adjustable.

2. The audio apparatus of claim 1, further comprising:

a shielder configured to:

cover at least a portion of the housing; and shield a space of an external auditory meatus of a user's ear from the external space of the housing, wherein the audio apparatus is provided on the user's ear, and wherein the shielder maintains the internal space of the housing and the space of the external auditory meatus at a uniform air pressure.

3. The audio apparatus of claim 2, wherein the at least one microphone comprises:

a first microphone configured to acquire the ambient sound of the audio apparatus, and a second microphone configured to receive the ambient sound of the audio apparatus and the audio signal output through the speaker, and wherein the audio signal processor is further configured to generate the anti-noise signal by using the ambient sound of the audio apparatus acquired by the first microphone, the ambient sound of the audio apparatus received by using the second microphone, and the audio signal output through the speaker and received using the second microphone.

4. The audio apparatus of claim 3, wherein the audio signal processor further comprises a third controller configured to:

control the speaker to output a test signal for each frequency;

control the second microphone to acquire a feedback signal, the feedback signal being feedback to the test signal that has returned after being reflected by the external auditory meatus of the user's ear; and adjust frequency characteristics of the audio signal by analyzing the feedback signal acquired using the second microphone, and wherein the feedback signal is acquired differently according to a structure of the space of the external auditory meatus of the user's ear.

5. The audio apparatus of claim 4, wherein the third controller is further configured to adjust the frequency characteristics of the audio signal by further using an amplitude of the test signal or hardware characteristics of the speaker.

6. The audio apparatus of claim 1, further comprising:

a pressure sensor configured to sense an air pressure of a space of an external auditory meatus of a user's ear, wherein the audio signal processor is further configured to adjust an intensity of the anti-noise signal based on air pressure values sensed by the pressure sensor.

7. The audio apparatus of claim 6, wherein the audio signal processor comprises:

a noise canceler configured to generate the anti-noise signal for canceling noise in the ambient sound, and a first controller configured to determine a noise cancellation coefficient for adjusting the intensity of the anti-noise signal based on the air pressure values sensed by the pressure sensor, and wherein the anti-noise signal is generated according to the intensity of the anti-noise signal adjusted using the determined noise cancellation coefficient.

8. The audio apparatus of claim 7, wherein the first controller is further configured to determine the noise cancellation coefficient by using a variation in the air pressure values sensed by the pressure sensor a plurality of times.

9. The audio apparatus of claim 8, wherein the first controller is further configured to:

estimate an average air pressure curve indicating a variation tendency in an air pressure of a space of the external auditory meatus by using an average of the air pressure values sensed by the pressure sensor the plurality of times, and determine the noise cancellation coefficient by further using the estimated average air pressure curve.

10. The audio apparatus of claim 7, wherein the audio signal processor further comprises a second controller configured to adjust the intensity of the anti-noise signal by using a noise cancellation coefficient determined using the first controller, and wherein the anti-noise signal is generated according to the intensity of the anti-noise signal adjusted using the second controller.

11. The audio apparatus of claim 1, wherein the audio signal processor is further configured to adjust frequency characteristics of the audio signal output through the speaker according to the location of the porous member in the fluid tube.

12. An audio signal processing method performed by an audio apparatus outputting an audio signal provided by an electronic device, the audio signal processing method comprising:

adjusting a change in an air pressure of an internal space of a housing of the audio apparatus by using a fluid tube connecting an external space of the housing of the audio apparatus and the internal space of the housing, the fluid tube extending from the external space of the housing into the internal space of the housing, a portion of the fluid tube being fixed inside the housing;

acquiring an ambient sound of the audio apparatus by using at least one microphone;

generating an anti-noise signal by using the ambient sound acquired by the at least one microphone, the anti-noise signal being a signal that cancels noise in the ambient sound; and outputting the anti-noise signal and the audio signal through a speaker of the audio apparatus, wherein the fluid tube comprises a porous member disposed therein, the porous member being configured to suppress a flow of air flowing through the fluid tube between the external space of the housing and the internal space of the housing, and wherein a location of the porous member disposed in the fluid tube is adjustable.

13. The audio signal processing method of claim 12, wherein the audio apparatus is provided on a user's ear, wherein the audio signal processing method further comprises sensing an air pressure of a space of an external auditory meatus of the user's ear by using a pressure sensor, and wherein the generating of the anti-noise signal comprises generating the anti-noise signal based on the sensed air pressure of the space of the external auditory meatus.

14. The audio signal processing method of claim 13, wherein the generating of the anti-noise signal further comprises adjusting an intensity of the anti-noise signal, and wherein the intensity of the anti-noise signal is adjusted based on the sensed air pressure of the space of the external auditory meatus.

15. The audio signal processing method of claim 13, wherein the generating of the anti-noise signal further comprises:

determining a noise cancellation coefficient for adjusting an intensity of the anti-noise signal based on the sensed air pressure of the space of the external auditory meatus, and adjusting the intensity of the anti-noise signal by using the determined noise cancellation coefficient, and wherein the anti-noise signal is generated according to the adjusted intensity of the anti-noise signal.

16. The audio signal processing method of claim 15, wherein the determining of the noise cancellation coefficient comprises determining the noise cancellation coefficient by using a variation in air pressure values sensed by the pressure sensor a plurality of times.

17. The audio signal processing method of claim 15, wherein the generating of the anti-noise signal further comprises estimating an average air pressure curve indicating a variation tendency in the air pressure of the space of the external auditory meatus by using an average of air pressure values sensed by the pressure sensor a plurality of times, and wherein the noise cancellation coefficient is determined by using the estimated average air pressure curve.

18. The audio signal processing method of claim 13, further comprising:

adjusting frequency characteristics of the audio signal according to a structure of the space of the external auditory meatus of the user's ear, wherein the audio signal having the adjusted frequency characteristics is output through the speaker together with the anti-noise signal.

19. A non-transitory computer-readable recording medium having an executable program recorded thereon, wherein the program, when executed by a computer, instructs the computer to perform the method of claim 12.

* * * * *